US005831495A

United States Patent [19]

Hino

[11] Patent Number: 5,831,495

[45] Date of Patent: Nov. 3, 1998

[54] DIELECTRIC FILTER INCLUDING LATERALLY EXTENDING AUXILIARY THROUGH BORES

[75] Inventor: Seigo Hino, Nagoya, Japan

[73] Assignee: NGK Spark Plug Co., Ltd., Japan

[21] Appl. No.: 654,411

[22] Filed: May 28, 1996

[30] Foreign Application Priority Data

May 29, 1995 [JP] Japan ..... 7-130794

[51] Int. Cl.[6] ..... H01P 1/202

[52] U.S. Cl. ..... 333/202; 333/206

[58] Field of Search ..... 333/206, 207, 333/202, 202 DB

[56] References Cited

U.S. PATENT DOCUMENTS

| | | | |
|---|---|---|---|
| 4,523,162 | 6/1985 | Johnson | 333/203 X |
| 5,489,882 | 2/1996 | Ueno | 333/222 X |
| 5,528,207 | 6/1996 | Ito | 333/222 |

FOREIGN PATENT DOCUMENTS

| | | |
|---|---|---|
| 1 266 374 | 4/1968 | Germany . |
| 57-39601 | 3/1982 | Japan . |
| 60-114004 | 6/1985 | Japan . |
| 61-64706 | 5/1986 | Japan . |
| 62-181005 | 11/1997 | Japan . |
| WO 85/00929 | 2/1985 | WIPO . |

*Primary Examiner*—Benny Lee
*Attorney, Agent, or Firm*—Larson & Taylor

[57] ABSTRACT

A dielectric filter comprising a dielectric ceramic block which has at least two through bores longitudinally extended in parallel with each other each of which is provided with a resonant conductor, and two auxiliary through bores each being laterally extended from the associated through bore to both lateral side surfaces of the dielectric ceramic block and being provided with an inner conductive film on the inner peripheral surface thereof, one end of the inner conductive film in each auxiliary through bore is separated from a shield electrode provided on the outer surface of the dielectric ceramic block so as to form an open circuit end.

8 Claims, 3 Drawing Sheets

DIELECTRIC FILTER INCLUDING LATERALLY EXTENDING AUXILIARY THROUGH BORES

BACKGROUND OF THE INVENTION

The present invention relates to a dielectric filter for a mobile radio communication device such as, for example, a portable telephone or the like.

There have been proposed various dielectric filters in which a plurality of through bores are provided in a dielectric ceramic block of a rectangular parallelepiped shape so that they are extended in parallel with each other from one end surface to the opposite end surface of the dielectric ceramic block, inner conductive films are provided on inner surfaces of the respective through bores for forming resonant conductors, an outer conductive film is provided on generally the entire outer peripheral surface of the dielectric ceramic block except the one end surface for forming a shield electrode, each resonant conductor has one end opened at the one end surface of the block to form an open circuit end and the other end connected to the shield electrode on the opposite end surface of the block to form a short circuit end (refer to, for example, Japanese Patent Kokai 60-114004, Japanese Utility Model Kokai 62-181005, Japanese Utility Model Kokai 61-64706, Japanese Patent Publication 3-40962 and Japanese Patent Kokai 3-6102).

Recently, from the points of view of requirements of a reduction in the size and the weight of the portable telephone and a direct mounting of the dielectric filter of this type on a printed circuit board, there have been demands for reduction in size and thickness of such a dielectric filter.

In the dielectric filter and particularly in a 1/4λ type coaxial resonator, however, when the length of a resonator is L, a light velocity is c, a resonant frequency is $f_o$ and a relative dielectric constant of a dielectric material is $\epsilon_r$, the following relationship is satisfied.

$$L=c/(4f_o\sqrt{\epsilon r})$$

As will be understood from this relationship, when the dielectric material to be used and the resonant frequency to be intended are determined, the length L of the resonator will be indispensably determined. This means that the length of the resonator cannot be shortened even if the thickness of the dielectric filter can be reduced in a structural manner, and thus the reduction in the size of the filter is limited.

On the other hand, the resonant frequency $f_o$ of the dielectric filter is represented by:

$$f_o=\tfrac{1}{2}\pi(LC)^{1/2}$$

where L is the equivalent inductance of the resonator, and C is the equivalent capacitance of the resonator.

Accordingly, it has been well recognized achieved to regulate the resonant frequency of the filter by regulating the equivalent inductance or the equivalent capacity of the resonator. In other words, in the dielectric filter it is necessary to regulate the resonant frequency to a desired value so as to compensate for the unevenness of the dielectric constant of the electric ceramic block to be used and/or any variation in the capacitance after assembling or directly mounting on the printed circuit board. This is achieved by normally removing a portion of the conductor of the open circuit end of the resonator or adding a conductor to the open circuit end thereby to alter the length of the resonator.

With an arrangement disclosed in Japanese Patent Kokai 3-6102, for example, in order that the dielectric filter is surface mounted on the printed circuit board and the frequency regulation is facilitated, the dielectric ceramic block is provided with regulating through bores each of which is vertically extended from the through bore for the resonator to the one side surface parallel with the arraying direction (or both longitudinal axes) of the through holes of the dielectric block. Each regulating through bore has an inner surface provided a metal film. The resonant frequency is regulated by partially removing the metal film on the inner surface of the each regulating through bore from the open end thereof. In this case, in view of the circuit arrangement the resonant conductors are connected in parallel with each other by the inner metal films of the regulating through bores so that the capacitive component of the resonator can be increased, and consequently the resonant frequency can be decreased as will be appreciated from the relation mentioned above.

In this way, the capacitance of the dielectric filter can be increased by providing such frequency regulating through bores. Therefore, if the resonant frequency is fixed at a predetermined value, the resonant length can be shortened that much. However, with the arrangement disclosed in Japanese Patent Kokai 3-6102 in which the frequency regulating through bores are perpendicularly provided at one side surface or top side surface of the electric material block, in order to make the reduction in size of the filter while satisfying the requirement for the reduction in thickness, it is difficult to increase the capacitance to such an extent that the resonant length can be substantially shortened because the thickness of the dielectric ceramic block cannot be increased. Therefore, the previously proposed arrangement cannot simultaneously satisfy both the requirements for the thickness and the size.

Furthermore, the dielectric filter of this type is sometimes desired to have interstage coupling electrodes for capacitively coupling the adjacent resonant conductors, each of which is arranged on the side surface of the block opposite to the printed circuit board in such a manner that it is separated from the shield electrode on the block. However, since a plurality of frequency regulating through bores are opened at the one side end of the dielectric block as described above, there arises a problem that such through bores disturb the easy formation of the interstage coupling electrodes.

It is, therefore, an object of the present invention to provide a dielectric filter in which the above-described problems can be overcome and the requirements for reduction in thickness and size can be simultaneously satisfied.

SUMMARY OF THE INVENTION

According to one aspect of the present invention, there is provided a dielectric filter comprising a dielectric ceramic block in which a plurality of through holes are arranged to be extended in parallel with each other from one end surface thereof to the other end surface opposed to said one end surface. These through holes are provided with inner conductive films on inner peripheral surfaces thereof. A shield electrode is formed substantially on an entire outer peripheral surface of the dielectric ceramic block except on the one end surface thereof, and each resonant conductor has one end opened at the one end surface of the block to form an open circuit end and the other end connected to the shield electrode on the opposite end surface of the block to form a short circuit end. The filter also comprises two auxiliary through bores which are laterally extended from the through holes to form a pair of resonant conductors disposed at an initial stage and a final stage to both lateral side surfaces of the dielectric ceramic block. These through bores are provided with inner conductive film on the inner peripheral surface thereof, and a portion of the inner conductive film positioned on an opening of each auxiliary through bore is separated from a shield electrode provided on the outer surface of the dielectric ceramic block so as to form an open circuit end.

According to another aspect of the present invention, there is provided a dielectric filter comprising a dielectric ceramic block in which three through holes are arranged to be extended in parallel with each other from one end surface thereof to the other end surface opposed the one end surface and are provided with inner conductive films on inner peripheral surfaces thereof. A shield electrode is formed substantially on an entire outer peripheral surface of the dielectric ceramic block except on the one end surface thereof, and each resonant conductor has one end opened at the one end surface of the block to form an open circuit end and the other end connected to the shield electrode on the opposite end surface of the block to form a short circuit end. The filter also comprises two auxiliary through bores which are laterally extended from the through holes for the resonant conductors disposed at first and third stages to both lateral side surfaces of the dielectric ceramic block and which are provided with inner conductive films on inner peripheral surfaces thereof. A portion of the inner conductive film positioned on an opening of each auxiliary through bore is separated from the shield electrode provided on the outer surface of the dielectric ceramic block so as to form an open circuit end.

In the present invention, it is preferable that a distance between a center of the through hole of each of the outermost resonant conductors and the lateral side surface of the dielectric ceramic block is larger than a distance between the center of the through hole of each of the outermost resonant conductors and the top side surface of the dielectric ceramic block.

Each auxiliary through bore may be positioned near the open circuit end surface of the dielectric ceramic block.

BRIEF DESCRIPTION OF THE DRAWINGS

These and other objects and features of the present invention will become apparent from the following description of preferred embodiments thereof with reference to the accompanying drawings, in which.

DETAILED DESCRIPTION OF THE PREFERRED EMBODIMENTS

Figure 1:
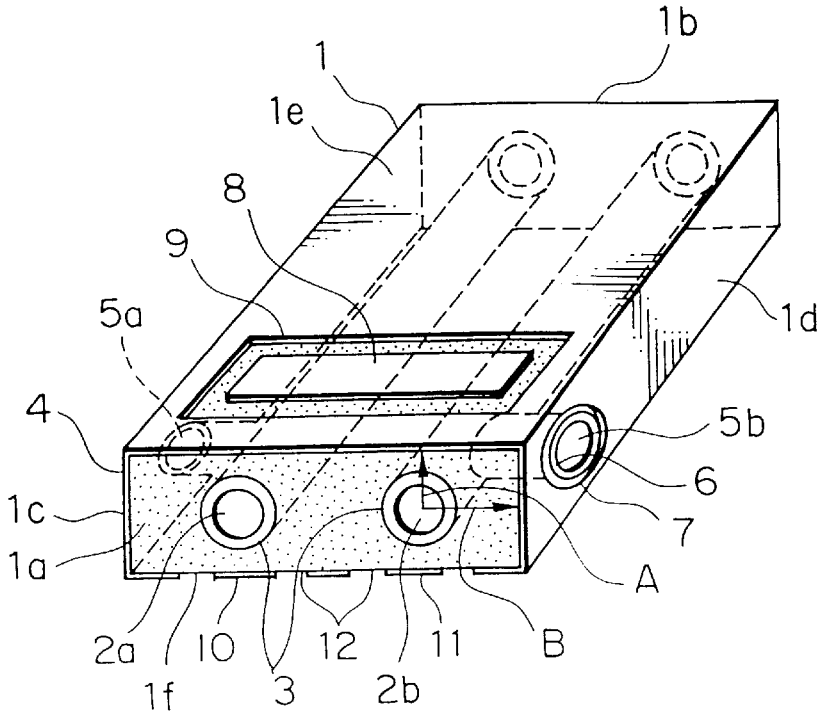
FIG. 1 is a schematic perspective view showing a dielectric filter according to one preferred embodiment of the present invention.

In the following description of the present invention, it is to be noted that mutually same or similar components are denoted by the same reference numerals throughout the accompanying drawings.

Figure 2:
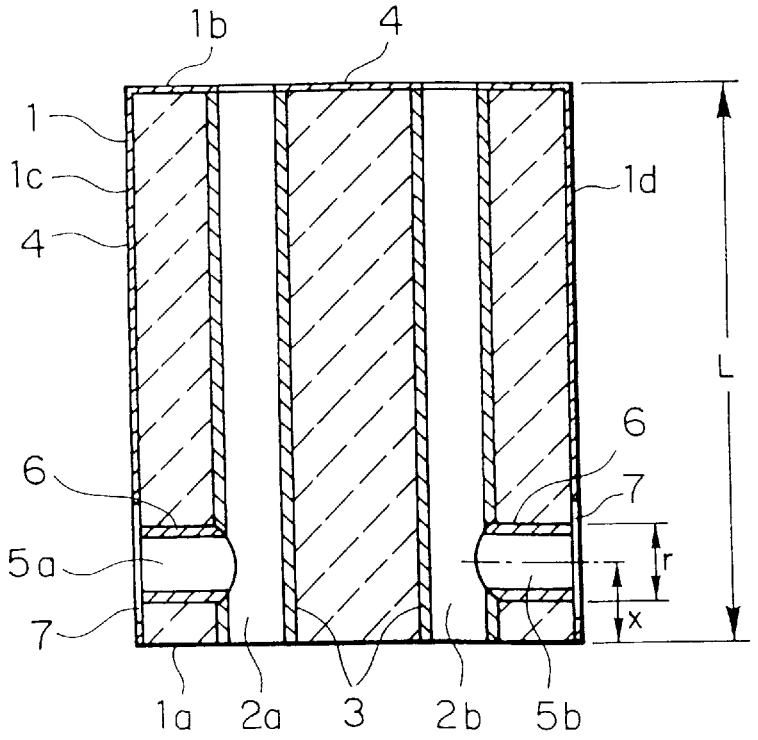
FIG. 2 is a schematic horizontal section view taken along a plane including axes of resonator through holes of the dielectric filter of FIG. 1.
Figure 3:
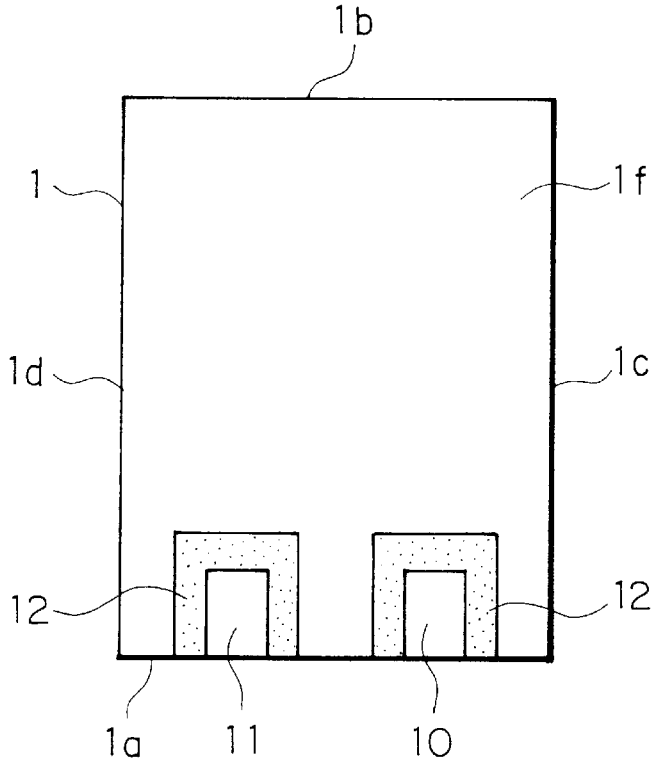
FIG. 3 is a schematic bottom view of the dielectric filter of FIG. 1.

Referring now to FIGS. 1 through 3, there is illustrated in different views as noted above a dielectric filter according to one preferred embodiment of the present invention. The illustrated dielectric filter comprises a dielectric ceramic block 1 which has substantially rectangular parallelepiped shape and is typically made of a dielectric ceramic material such as titanium oxide. The dielectric ceramic block 1 is provided with two through holes 2*a* and 2*b* which are arranged to be extended in parallel with each other from a front end surface 1*a* to a rear end surface 1*b* of the dielectric ceramic block 1. Each of the through holes 2*a* and 2*b* has an inner peripheral surface formed with an inner conductive film 3 which constitutes a resonant conductor. A shield electrode 4 is provided substantially on the entire outer peripheral surfaces 1*b*, 1*c*, 1*d*, 1*e*, and 1*f* of the dielectric ceramic block 1 except the front end surface 1*a* of the block 1. In this embodiment this shield electrode 4 has a function as a grounding electrode. Each of the inner conductive films 3 of the inner surfaces of the through holes 2*a* and 2*b* has one end or an open circuit end bordered on the front end surface 1*a* of the dielectric ceramic block 1 and the other end or a short circuit end bordered on the rear end surface 1*b* of the dielectric ceramic block 1 and connected to the shield electrode 4.

The dielectric ceramic block 1 is also provided with auxiliary through bores 5*a* and 5*b* at the regions adjacent to the open circuit end surface 1*a* of the block 1. As will be seen best in FIG. 2 these auxiliary through bores 5*a* and 5*b* are laterally extended from the through holes 2*a* and 2*b* of the resonant conductors to lateral side surfaces 1*c* and 1*d* of the dielectric ceramic block 1, respectively. Each of the auxiliary through bores 5*a* and 5*b* has an inner peripheral surface provided with an inner conductive film 6. Each of the inner conductive films 6 in the auxiliary through bores has an inner end connected to the associated inner conductive films 3 in the through holes 2*a* and 2*b* and an outer end electrically separated from the shield electrode 4 on the outer peripheral surface of the dielectric ceramic block 1 by an insulating space 7. Then the outer end of the inner conductive film 6 in each auxiliary through bore is formed as an open circuit end. The space 7 may be formed by removing the shield electrode parts on the area surrounding the outer end of the inner conductive film 6 as shown in FIGS. 1 and 2. In this case, if the inner diameters of the auxiliary through bores 5*a* and 5*b* are increased to increase the area of the inner conductive films 6, the capacitive component of the resonator can be increased. This means that even if the length of the resonator is shortened, a desired or intended resonant frequency can be obtained.

Further, as shown in FIG. 1, an interstage coupling electrode 8 is provided on the upper side surface 1e of the dielectric ceramic block 1 at a position near the front end surface 1*a* thereof. This interstage coupling electrode 8 is laterally extended across the resonant conductors 3 and is electrically separated from the shield electrode 4 by an insulating space 9 as shown in FIG. 1. The interstage coupling electrode 8 may also be formed by partially removing the shield electrode 4 to form the insulating space 9 which surrounds the interstage coupling electrode 8.

In addition, as shown in FIG. 3, an input coupling electrode 10 and an output coupling electrode 11 are provided on the bottom side surface 1*f* and are arranged to be correspondent to the open circuit ends of the resonant conductors 3. The input and output coupling electrodes 10 and 11 are electrically separated from the shield electrode 4 by insulating spaces 12, and are connected to an input/output circuit section on a printed circuit board (not shown).

In the filter constructed as described above and with particular reference to FIG. 2, in order to illustrate how a resonant length L necessary for a predetermined resonant frequency (e.g, $f_o$=865.5 MHz) may relate to a distance x from the center of each of the auxiliary through bores 5*a* and 5*b* to the front end surface 1*a* and an inner diameter r of each auxiliary through bore, some examples will be described as follows:

The case where the inner diameter r of each auxiliary through bore 5*a* and 5*b* is set (0.7 mm), and the distance x is varied:

| Distance x(mm) | Resonance length L(mm) |
|---|---|
| No through bore | 10.0 |
| 1.0 | 8.7 |
| 1.5 | 8.9 |
| 2.0 | 9.1 |

The case where the distance x from the front end surface 1*a* to the center of each auxiliary through bore 5*a* and 5*b* is set to 1.5 mm, and the inner diameter r is varied:

| Inner diameter r(mm) | Resonance length L(mm) |
|---|---|
| No through bore | 10.0 |
| 0.5 | 9.2 |
| 0.7 | 8.9 |
| 0.9 | 8.6 |

As will be appreciated from the above measurement examples, when the distance x from the center of the each auxiliary through bore 5*a* and 5*b* to the front end surface 1*a* is decreased and the inner diameter r of the each auxiliary through bore 5*a* and 5*b* is increased, the resonant length L may be shortened.

Figure 4:
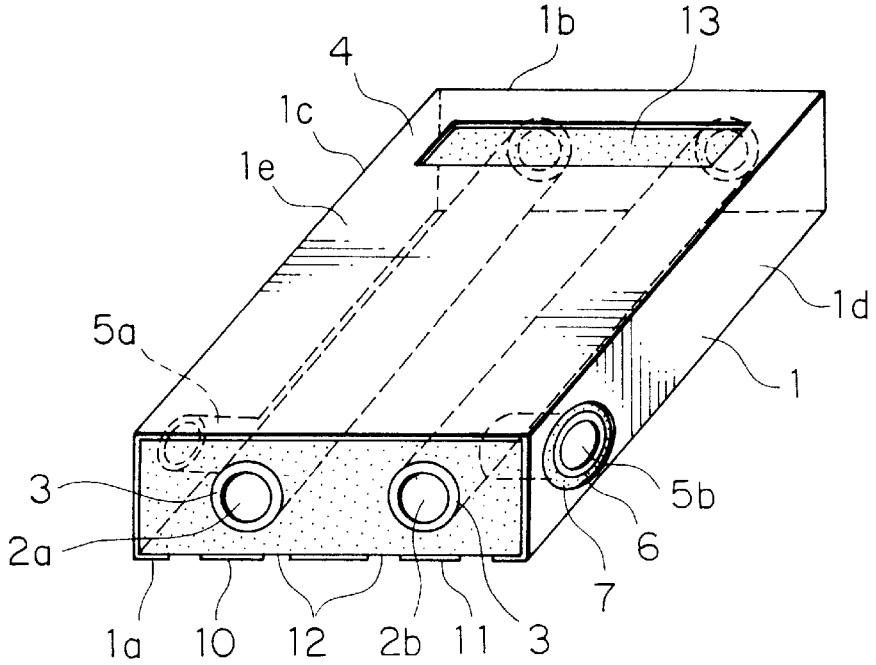
FIG. 4 is a schematic perspective view showing a modification of the dielectric filter of FIG. 1.

FIG. 4 illustrates a modification of the embodiment shown in FIGS. 1 through 3. In this case, coupling between the resonators is achived by removing the portion of the shield electrode on the upper or top side surface 1*e*, which is adjacent to the short-circuited rear end surface 1*b*, so that a strip shape non-conductive region 13 is formed along a direction perpendicular to the axes of the through holes 2*a* and 2*b*. The other arrangement is substantially the same as that of the previous embodiment and accordingly the corresponding components to those of the previous embodiment are designated by the same reference numerals.

In the filter illustrated with reference to FIG. 4 and as described above, when a distance A (illustrated in FIG. 1) from the center of each through hole 2*a* and 2*b* to the top side surface 1*e* of the dielectric ceramic block 1 is compared with a distance B (illustrated in FIG. 1) from the center of each through hole 2*a* and 2*b* to the lateral side surface 1*c* or 1*d* in view of the requirement of reduction in thickness of the filter, as shown in FIG. 1 the distance B is normally larger than the distance A. Accordingly, since the auxiliary through bores 5*a* and 5*b* are extended in lateral direction but not in thickness or vertical direction of the block 1, each of the bores 2*a* and 2*b* may be arranged to have sufficient length and thus the resonant length can be substantially shortened by optimally selecting the position and the inner diameter of each bore 5*a* and 5*b* based on the above-described measurement results, thereby reducing the size of the filter itself.

Figure 5:
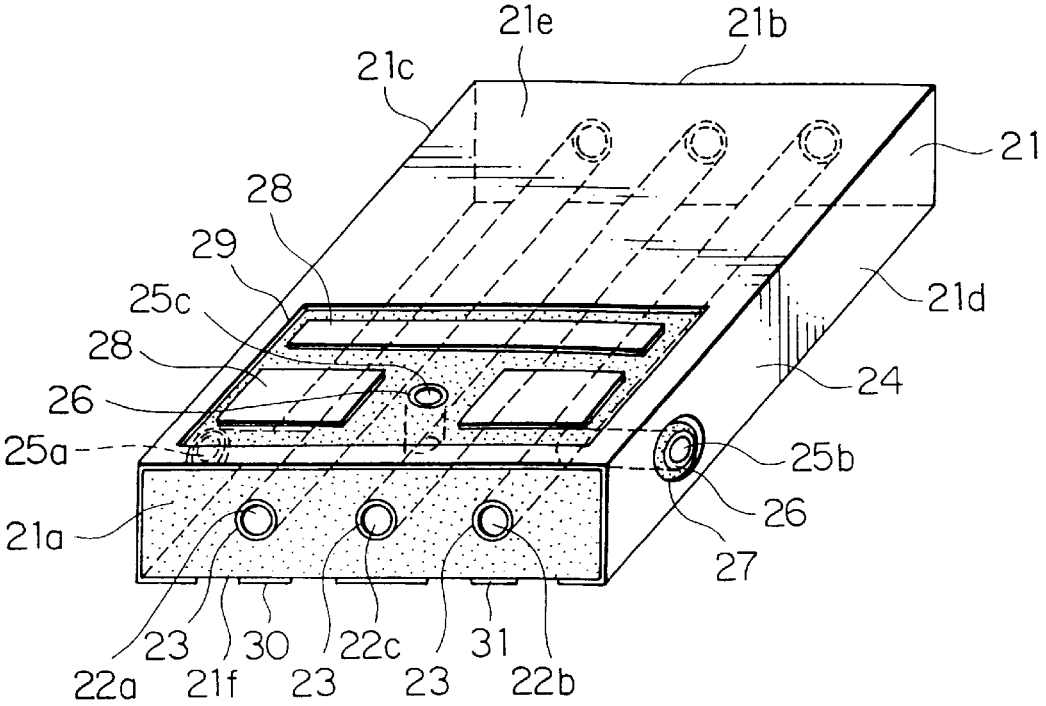
FIG. 5 is a schematic perspective view showing a dielectric filter according to another embodiment o the present invention.
Figure 6:
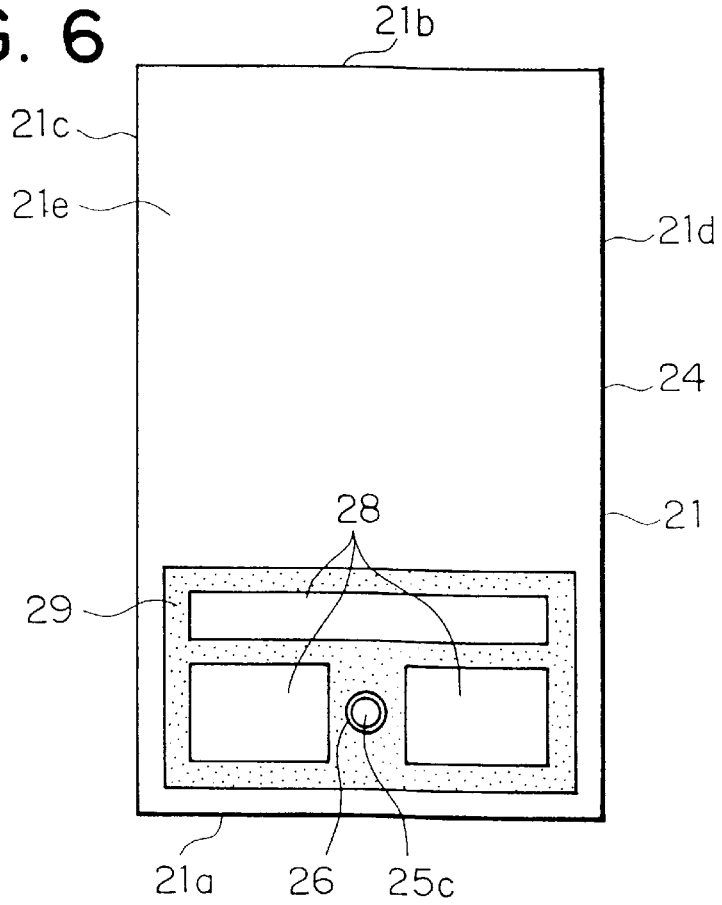
FIG. 6 is a schematic plan view of the dielectric filter of FIG. 5.

FIGS. 5 and 6 illustrate another embodiment of the present invention which is directed to a three-stage type dielectric filter. In this embodiment, a dielectric ceramic block 21 of dielectric ceramic material is provided with three through holes 22*a*, 22*b* and 22*c* which are arranged to be extended in parallel with each other from a front end surface 21*a* to a rear end surface 21*b* of the dielectric ceramic block 21. Each through hole has an inner peripheral surface coated with an inner conductive film 23 for forming respective resonant conductors. Shield electrode 24 is provided substantially on the entire outer peripheral surface of the dielectric ceramic block 21 except the front end surface 21*a* of the block 21 which is formed as an open circuit end surface. The inner conductive film 23 in each of the through holes 22*a* to 22*c* has one end extended to the front end surface 21*a* of the dielectric ceramic block 21 and the other end extended to the rear end surface 21*b* and connected to the shield electrode 24. Therefore, one end of the inner conductive film 23 extended to the front end surface 21*a* forms an open circuit end, while the other end extended to the rear end surface 21*b* forms a short circuit end.

The dielectric filter includes auxiliary through bores 25*a* and 25*b* which are provided on the portion of the block 21 adjacent to the front end surface 21*a* and are laterally extended from through holes 22*a* and 22*b* of first and third resonant conductors laterally disposed to lateral side surfaces 21*c* and 21*d* of the dielectric ceramic block 21. On the inner peripheral surface of each of the auxiliary through bores 25*a* and 25*b* is provided an inner conductive film 26 which has one end or inner end connected to the resonant conductor 23 and the other end or outer end extended to the lateral side surface 21*c* or 21*d* of the dielectric ceramic block 21 and separated from the shield electrode 24 on the lateral side surface by an insulating space 27. This insulating space 27 may be formed by removing the portion of the shield electrode 24 surrounding the outer end of the inner conductive film 26 as shown in FIG. 5.

The dielectric filter also includes an auxiliary through bore 25*c* which is provided on the portion of the block 21 adjacent to the front end surface 21*a* and is vertically extended from the through hole 22*c* of a second resonant conductor disposed at a center of the block 21 to the top side surface 21*e* of the block 21, That is, this auxiliary through bore 25*c* is extending in the thickness direction of the dielectric ceramic block 21. Also, the vertically extended through bore 25*c* is provided with an inner conductive film 26 on the inner peripheral surface thereof. This inner conductive film 26 may be formed similarly to that of the auxiliary through bores 25*a* and 25*b*. The inner conductive film 26 in the vertically extended through bore 25*c* has an inner end connected to the resonant conductor 23 of the center through hole 22*c* and an outer end separated from the shield electrode 24 on the top side surface 21*e* to form an open circuit end.

Furthermore, the dielectric filter includes three interstage coupling electrodes 28 which are provided on the region of the top side surface 21*e* adjacent to the front end surface 21*a* of the dielectric ceramic block 21. Each of the interstage coupling electrodes 28 is insulated from the shield electrode 24 provided on the top side surface 21*e* by partly removing the surrounding shield electrode 24 as shown by insulating space 29 in FIGS. 5 and 6.

Similarly to the case of the first embodiment described above, an input coupling electrode 30 and an output coupling electrode 31 are provided on the bottom side surface 21*f* of the dielectric ceramic block 21 and are electrically separated from the shield electrode 24 on the top side surface 21*e* of the block 21. The input and output coupling electrodes 30 and 31 are connected to an input/output circuit section of a printed circuit board not shown.

According to the dielectric filter of the present invention as described above, the auxiliary through bores are laterally extended from the through holes of the initial and final stage resonant conductors to both lateral side surfaces of the dielectric ceramic block and are provided with the inner conductive films on the inner peripheral surfaces thereof, and the outer end of each of the inner conductive films is separated from the shield electrode on the outer surface of the block to form the open circuit end. In case of two stage dielectric filter, therefore, the auxiliary through bores can be arranged to have relative longer lengths, and hence the capacitive component of each resonator can be substantially increased. Thus, since the resonant length can be shortened, the size of the resonator in the length direction can be shortened, and the substantial reduction in the size of the filter can be attained.

Also, the size of the resonator in the longitudinal direction can be shortened by providing the auxiliary through bores near the open circuit ends of the resonant conductors or increasing the inner diameters of the auxiliary through bores as large as possible.

Further, in case of three or more stage dielectric filter no auxiliary through bore is provided on the top side surface of the dielectric block, or even if provided, such auxiliary through bore is less in number, and hence the interstage coupling electrode can be easily arranged on the top side surface of the electric block as desired without any disturbance due to the presence of the auxiliary through bore(s).

In the embodiments illustrated and described above, the dielectric filter is of a comb line type in which the short circuit ends of the resonant conductors are disposed at one end side of the dielectric ceramic block and the open circuit ends of the resonant conductors are disposed at the other end side of the dielectric ceramic block. However, the present invention can be also applied to an interdigital type arrangement in which the short circuit ends and the open circuit ends of the resonant conductors are alternately disposed at opposite sides of the dielectric ceramic block.

Also, in the illustrated dielectric filter coupling between the resonators is achieved by providing the interstage coupling electrode on the upper or top side surface of the filter. However, instead other suitable way such as coupling bores between the resonators may be used for the interstage coupling.

Furthermore, the sectional shape of the resonant conductor may not be necessarily circular, but may be formed in an arbitrary shape as required.

I claim:

1. A dielectric filter comprising:

a dielectric ceramic block having a plurality of outer peripheral surfaces, said outer peripheral surfaces including first and second opposed outer end surfaces, first and second opposed outer lateral surfaces, an outer top surface, and an outer bottom surface opposite the top surface;

a shield electrode provided on the first and second outer lateral surfaces, the outer top and bottom surfaces and the second end surface;

a plurality of resonant conductors provided in the dielectric ceramic block and arranged in parallel with respect to each other, each said resonant conductor including a respective through hole extending from the first end surface to the second end surface of the dielectric ceramic block, and a respective hole inner conductive film which is provided on an inner peripheral surface of each said respective through hole and extending between (a) a first end opened at the first end surface which defines an open circuit end and (b) a second end at the second end surface connected to said shield electrode on the second end surface which defines a short circuit end;

respective input and output coupling electrodes located on one of the outer peripheral surfaces near said open circuit end and positioned to be capacitively coupled with respective first and last ones of said plurality of said resonant conductors; and first and second auxiliary through bores provided in the dielectric ceramic body, said first and second auxiliary through bores being laterally extended respectively between (a) a respective said through hole associated respectively with the first and last said resonant conductors and (b) respective other ones of said peripheral outer surfaces adjacent to the one outer peripheral surface, said first and second through bores being provided with a bore inner conductive film on a respective inner peripheral surface thereof, with a portion of the bore inner conductive film located at an opening of each auxiliary through bore at the respective other ones of said peripheral outer surfaces being separated from said shield electrode to define an open circuit.

2. A dielectric filter as claimed in claim 1, wherein a distance between a center of the respective said through hole of each of the first and last resonant conductors and the respective first and second lateral surfaces of the dielectric ceramic block is larger than a distance between the center of the respective said through holes of each of the first and last said resonant conductors and the top surface of the dielectric ceramic block.

3. A dielectric filter as claimed in claim 1, wherein each of said auxiliary through bores is positioned near the first end surface of said dielectric ceramic block.

4. A dielectric filter as claimed in claim 1, wherein the outer top surface of the dielectric ceramic block includes an interstage coupling electrode located near the first end surface of the dielectric ceramic block for capacitively coupling the respective said resonant conductors, and wherein each of said input, output and interstage electrodes is separated from said shield electrode.

5. A dielectric filter comprising:

a dielectric ceramic block having a plurality of outer peripheral surfaces, said outer peripheral surfaces including first and second opposed outer end surfaces, first and second opposed outer lateral surfaces, an outer top surface, and an outer bottom surface opposite the top surface;

a shield electrode provided on the first and second outer lateral surfaces, the outer top and bottom surfaces and the second end surface;

first, second, and third resonant conductors provided in the dielectric ceramic block and arranged in parallel with respect to each other, each said resonant conductor including a respective through hole extending from the first end surface to the second end surface of the dielectric ceramic block, and a respective hole inner conductive film which is provided on an inner peripheral surface of each said respective through hole and extending between (a) a first end opened at the first end surface which defines an open circuit end and (b) a second end at the second end surface connected to said shield electrode on the second end surface which defines a short circuit end;

respective input and output coupling electrodes located on the bottom surface near said open circuit end and positioned to be capacitively coupled respectively with said first and third resonant conductors; and first and second auxiliary through bores provided in the dielectric ceramic body, said first and second auxiliary through bores being laterally extended respectively between (a) a respective said through holes associated respectively with said first and third resonant conductors and (b) a respective first and second lateral surface adjacent to the bottom surface, said first and second through bores being provided with a bore inner conductive film on a respective inner peripheral surface thereof, with a portion of the bore inner conductive film located at an opening of each auxiliary through bore at respective first and second lateral surfaces being separated from said shield electrode to define an open circuit.

6. A dielectric filter as claimed in claim 5, wherein each of said auxiliary through bores is positioned near the first end surface of said dielectric ceramic block.

7. A dielectric filter as claimed in claim 5, wherein a distance between a center of the respective said through hole of each of the first and third resonant conductors and the respective first and second lateral surfaces of the dielectric ceramic block is larger than a distance between the center of the respective said through holes of each of the first and third said resonant conductors and the top surface of the dielectric ceramic block.

8. A dielectric filter as claimed in claim 5, wherein the outer top surface of the dielectric ceramic block includes at least one electrode located near the first end surface of the dielectric ceramic block for capacitively coupling the respective said resonant conductors, and wherein each of said input, output and at least one electrode is separated from said shield electrode.

* * * * *